US012070095B1

(12) United States Patent
Fasel et al.

(10) Patent No.: US 12,070,095 B1
(45) Date of Patent: Aug. 27, 2024

(54) FUNCTIONALLY GRADED STRUCTURES FOR IMPACT ABSORPTION

(71) Applicant: U.S. Government as Represented by the Secretary of the Army, Natick, MA (US)

(72) Inventors: Benjamin P Fasel, East Bridgewater, MA (US); David S Colanto, Natick, MA (US); Robert V Dilalla, Walpole, MA (US); Tony Kayhart, Cambridge, MA (US)

(73) Assignee: Government of the United States as Represented by the Secretary of the Army, Washington, DC (US)

( * ) Notice: Subject to any disclaimer, the term of this patent is extended or adjusted under 35 U.S.C. 154(b) by 9 days.

(21) Appl. No.: 17/692,445

(22) Filed: Mar. 11, 2022

Related U.S. Application Data

(63) Continuation of application No. 16/448,170, filed on Jun. 21, 2019, now abandoned.

(51) Int. Cl.
*A42B 3/06* (2006.01)
*A42B 3/12* (2006.01)

(52) U.S. Cl.
CPC ..... *A42B 3/063* (2013.01); *A42B 3/12* (2013.01)

(58) Field of Classification Search
CPC ..... A42B 3/063; A42B 3/12; A42B 3/06
See application file for complete search history.

(56) References Cited

U.S. PATENT DOCUMENTS

| | | | | |
|---|---|---|---|---|
| 10,315,095 | B1 * | 6/2019 | Sneed | A42B 3/20 |
| 2006/0163319 | A1 * | 7/2006 | Ervin | B23K 20/02 228/101 |
| 2014/0013492 | A1 * | 1/2014 | Bottlang | A42B 3/065 2/414 |
| 2016/0302496 | A1 * | 10/2016 | Ferrara | A41D 13/0007 |

* cited by examiner

*Primary Examiner* — Nathan E Durham
*Assistant Examiner* — Abby M Spatz
(74) *Attorney, Agent, or Firm* — Timothy M. Barlow

(57) ABSTRACT

A functionally graded structure for a protective device includes a plurality of lattice structures including at least a first lattice structure having a first geometry and a second lattice structure having a second geometry. The first lattice structure with the first geometry has a first compression response property and the second lattice structure with the second geometry has a second compression response property that is different from the first compression response property.

2 Claims, 10 Drawing Sheets

FUNCTIONALLY GRADED STRUCTURES FOR IMPACT ABSORPTION

CROSS-REFERENCE

This application is a continuation application of, and claims the benefit of, U.S. patent application Ser. No. 16/448,170 filed on Jun. 21, 2019.

STATEMENT OF GOVERNMENT INTEREST

The invention described herein may be manufactured and used by or for the U.S. Government for governmental purposes without the payment of any royalties thereon or therefor.

FIELD

The aspects of the present disclosure relate generally to the field of helmets, and in particular to a functionally graded structure for impact energy absorption in a protection device such as a helmet.

BACKGROUND

In the last few years, additive manufacturing (AM) has made it possible to fabricate lattice structures with geometries that were previously either impractical or impossible to fabricate by other methods. This AM technology has unlocked the potential to fabricate structures with optimized geometries for impact absorption, such as low velocity impact energy absorption. Elastomeric polymers are becoming widely available for use in additive manufacturing processes on various type of equipment including extruders. With the prevalence of injuries due to low velocity impacts, especially to the head, it has become increasingly important to develop better performing impact absorption systems.

Current padding in a helmet, such protective helmet for sport or military use, is generally in the form of an open cell, layered approach. While the shape of a head of a person will vary from person to person, custom fitting is generally not available. There is generally a limited range of sizes available, with a one size fits all approach.

Additionally, protective helmets are generally not optimized for the specific application. Rather, helmets are generally configured to provide general impact protection. The impact absorption layer in a helmet is typically attached to a comfort layer by some mechanical means.

Furthermore, blunt impact requirements for helmets are increasingly difficult to meet. Helmet pads must not only absorb energy, but must also be able to control deceleration during impacts. The pads must be comfortable and the weight maintained.

Accordingly, it would be desirable to provide an impact absorption system for a protective device such as a helmet that addresses at least some of the problems identified above.

BRIEF DESCRIPTION OF THE DISCLOSED EMBODIMENTS

As described herein, the exemplary embodiments overcome one or more of the above or other disadvantages known in the art.

According to a first aspect, the exemplary embodiments are directed to a functionally graded structure. In one embodiment, a functionally graded structure for a protective device includes a plurality of lattice structures including at least a first lattice structure having a first geometry and a second lattice structure having a second geometry, wherein the first lattice structure with the first geometry has a first compression response property and the second lattice structure with the second geometry has a second compression response property that is different from the first compression response property.

In a first possible implementation form of the functionally graded structure according to the first aspect, the plurality of lattice structures are arranged in a stack.

In a possible implementation form of the functionally graded structure an edge of one of the plurality of lattice structures in the stack is joined to an edge of an adjacent lattice structure in the stack.

In a possible implementation form of the functionally graded structure the first lattice structure defines a circular shape with a central opening and the second lattice structure is arranged inside the opening.

In a possible implementation form of the functionally graded structure the second lattice structure defines a circular shape with a central opening and at least one another lattice structure of the plurality of lattice structures is arranged inside the central opening defined by the circular shape of the second lattice structure.

In a possible implementation form of the functionally graded structure an order of lattice structures in the plurality of lattice structures in the stack is from a least stiff lattice structure to a most stiff lattice structure.

In a possible implementation form of the functionally graded structure the first lattice structure has a first thickness and the second lattice structure has a second thickness that is different from the first thickness.

In a possible implementation form of the functionally graded structure a thickness of a segment in first lattice structure varies from one end of the first lattice structure to another end of the first lattice structure.

In a possible implementation form of the functionally graded structure a grading of lattice structures in the plurality of lattice structures from one lattice structure to another lattice structure is non-uniform.

In a possible implementation form of the functionally graded structure at least one segment in the plurality of lattice structures comprises a non-permeable donut shaped body structure that defines a cavity, and wherein at least one lattice structure is arranged in at least a portion of the cavity.

In a possible implementation form of the functionally graded structure the at least one lattice structure arranged in the portion of the cavity of the donut shaped body structure is a functionally graded structure and comprises a first lattice structure having a first geometry, and at least one other lattice structure, the at least one other lattice having an other geometry different from the first geometry, wherein the first geometry has a first compression response property and the other geometry has a compression response property that is different from the first compression response property.

In a possible implementation form of the functionally graded structure the first geometry of the first lattice structure is a hemisphere shaped structure and the second lattice structure is disposed in a central portion of the hemisphere shaped structure.

In a possible implementation form of the functionally graded structure, the functionally graded structure further comprise another lattice structure of the plurality of lattice structures disposed on top of the hemisphere shaped structure of the first lattice structure.

In a possible implementation form of the functionally graded structure the protective device comprises a helmet with an outer shell and an inner liner, and the plurality of lattice structures are disposed between the outer shell of the helmet and the inner liner of the helmet.

According to a second aspect, the exemplary embodiments are directed to a protection helmet. In one embodiment, the protection helmet includes an outer shell, an inner liner, and a functionally graded structure disposed between the outer shell and the inner liner, the functionally graded structure comprising a plurality of lattice structures with different compression response properties, a geometry of one lattice structure of the plurality of lattice structures being different from a geometry of another lattice structure of the plurality of lattice structures.

In a first possible implementation form of the protection helmet according to the second aspect the plurality of lattice structures are arranged in a stack between the outer shell and the inner liner and an order of lattice structures in the stack is from a least stiff lattice structure to a most stiff lattice structure.

In a possible implementation form of the protection helmet according to the second aspect, one of the plurality of lattice structures defines a circular shape with a central opening and another one of the plurality of lattice structures is arranged inside the central opening.

In a possible implementation form of the protection helmet according to the second aspect, a thickness of a segment in the functionally graded structure varies from one end of the functionally graded structure to another end of the functionally graded structure.

In a possible implementation form of the protection helmet according to the second aspect, a grading of lattice structures in the plurality of lattice structures is non-uniform.

In a possible implementation form of the protection helmet according to the second aspect, at least one segment in the plurality of lattice structures comprises a non-permeable donut shaped body structure that defines a cavity, and wherein at least one lattice structure is arranged in at least a portion of the cavity.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF THE EXEMPLARY EMBODIMENTS OF THE DISCLOSURE

Figure 1:
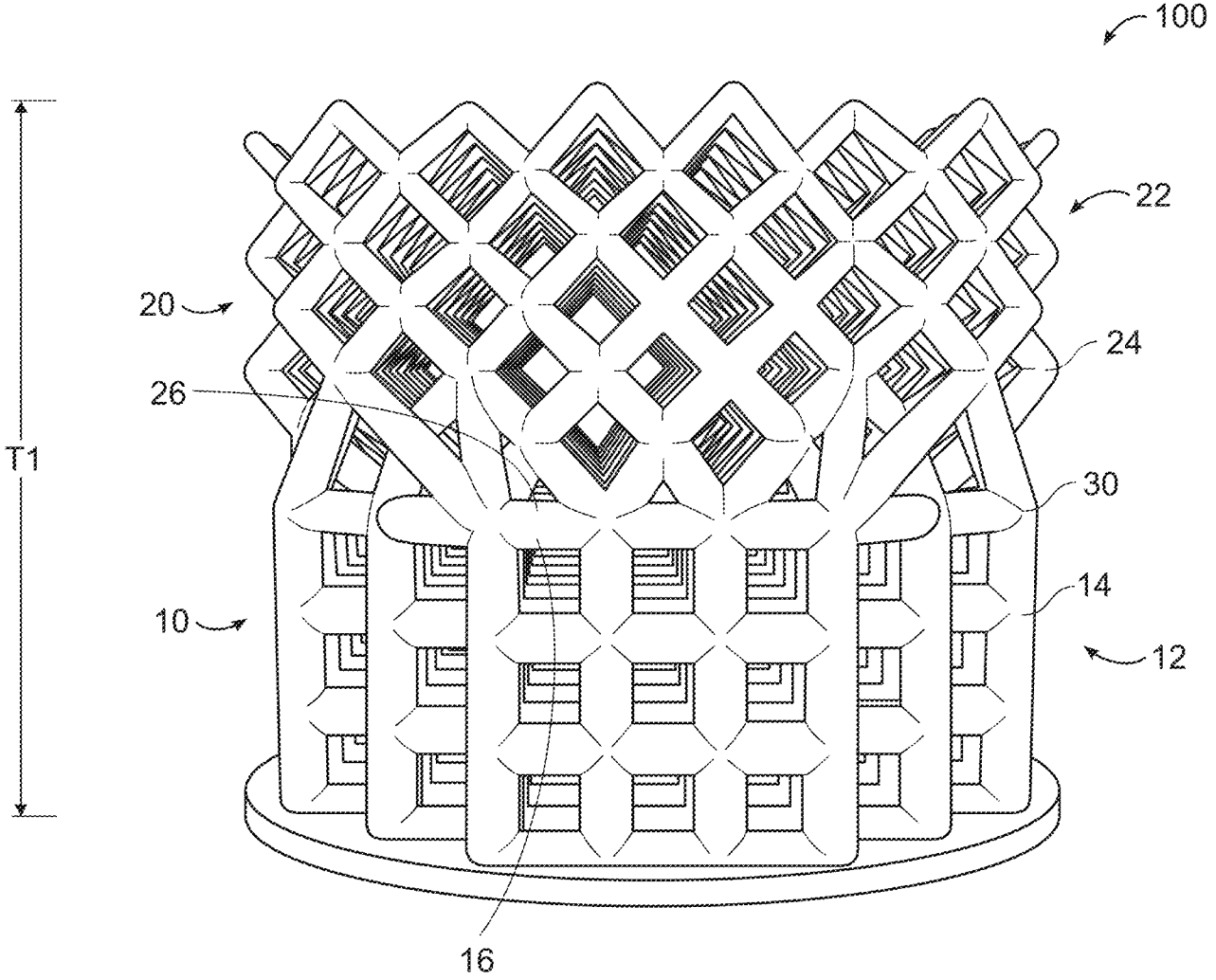
FIG. 1 illustrates a front view of an exemplary functionally graded structure incorporating aspects of the disclosed embodiments.

Referring to FIG. 1, one embodiment of functionally graded structure 100 incorporating aspects of the disclosed embodiments is illustrated. The aspects of the disclosed embodiments are directed to a functionally graded polymer structure that is optimized to absorb energy in a low impact velocity event. The functionally graded structure 100 of the disclosed embodiments finds application in helmets or wearable protection for activities such as sports, law enforcement and military operations. As will be described further herein, the functionally graded structure 100 of the disclosed embodiments is generally designed such that one or more of the geometry and thickness of the different lattice structures that make up the functionally graded structure vary. The repeating lattice structures of the functionally graded structure 100 are created in such a way that the physical properties vary throughout the thickness of the structure 100.

FIG. 1 illustrates one example of a functionally graded structure 100 incorporating aspects of the disclosed embodiments. As will be described further herein, the functionally graded structure can be implemented in a protective device, such as a helmet, for example. In this example, the functionally graded structure 100 comprises a first lattice structure 10 and at least one other or second lattice structure 20. The first lattice structure 10 has a first geometry 12 made up of a plurality of structures 14, also referred to as segments or struts, while the second lattice structure 20 has a second geometry 22 made up of a plurality of structures 24, also referred to herein as segments or struts. In one embodiment, the first geometry 12 provides or has a first compression response property and the second geometry 22 provides or has a second compression response property. The first compression response property can be different from the second compression response property. Although only two lattice structures 10 and 20 are illustrated in the example of FIG. 1, the aspects of the disclosed embodiments are not so limited. In alternate embodiments, the functionally graded structure 100 can include any number of lattice structures, other than including two.

In the example of FIG. 1, the two lattice structures 10, 20 are in a stacked arrangement, with the second lattice structure 20 disposed on top of the first lattice structure 10. Although only two lattice structures 10, 20 are shown in a stacked arrangement, the aspects of the disclosed embodiments are not so limited. In alternate embodiments, the functionally graded structure 100 can include any number of stacked lattice structures, other than including two.

In one embodiment, the edge structures 16, 26, also referred to herein as segments or struts, of the respective lattice structures 10, 20 intersect. Nodes, such as node 30, are created along the points of intersection of the edge structures 16, 26 to create a fluid geometry.

The first geometry 12 and the second geometry 22 will be configured to have a respective compression response property, or other physical characteristic, so that as compression occurs, the response of the functionally graded structure 100 to the compression, changes throughout the thickness T1 of the structure 100. In one embodiment, a first geometry 12 that is different from the second geometry 22 can be used to provide different compression response properties for the first lattice structure 10 and the second lattice structure 20. In another embodiment, a stiffness of the first lattice structure 10 and the stiffness of the second lattice structure 20 can provide a certain compression response property.

For example, in one embodiment, rather than being the same, a stiffness of the first geometry 12 and a stiffness of the second geometry 22 can be different. Thus, as compression occurs, the compression response changes throughout the thickness T1 of the structure 100. In one embodiment, an arrangement of the different lattice structures 10, 20 in the functionally graded structure 100, can be based on a respective stiffness of each structure in the stack.

Figure 2B:
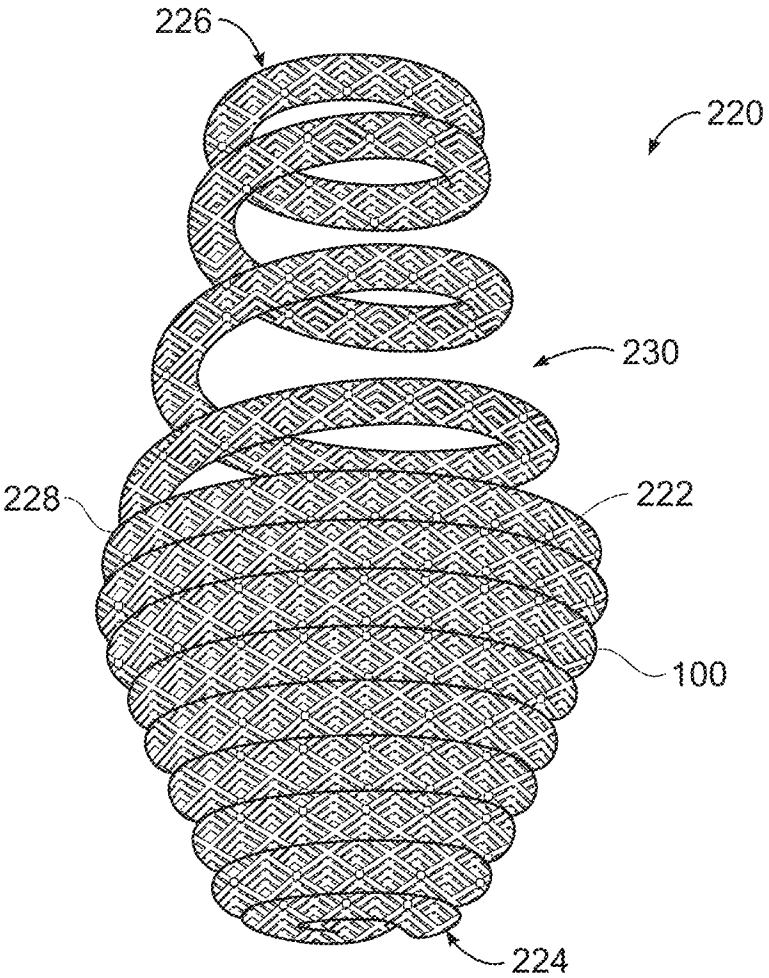
FIGS. 2A and 2B illustrate front views of exemplary functionally graded structures incorporating aspects of the disclosed embodiments.
Figure 2A:
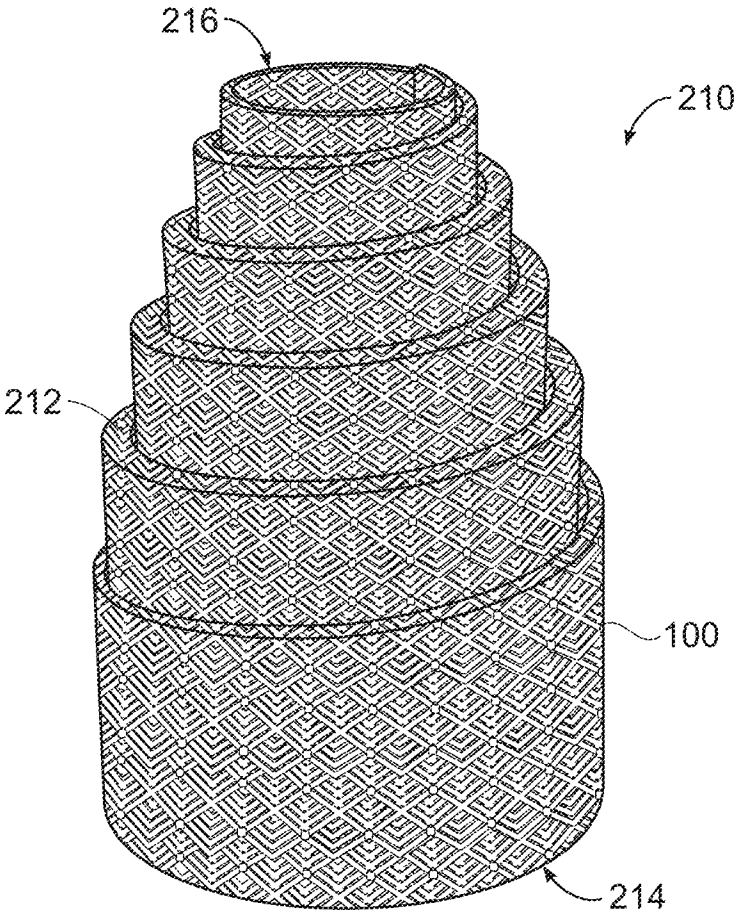

Referring to FIGS. 2A and 2B, examples of how the functionally graded structure 100 of FIG. 1 can used to form different volute lattice structures 210, 220, respectively, is illustrated. In this example, multi-tier lattice geometry structures are created such that they perform in a manner similar to what is known as a "volute spring." As is shown in the example of FIG. 2A, aspects of the functionally graded structure 100 of FIG. 1 can be configured to wind around itself to from the volute structure 210. In this manner, each wind 212 or portion of the volute lattice structure 210 fits inside the other, thus increasing the total potential stroke or strain. In this example, one or more of the first lattice structure 10 and the second lattice structure 20 can make up the volute lattice structure 210. In alternate embodiments, lattice structures other than including the first lattice structure 10 and the second lattice structure 20 can be used to form the volute structure 210. In one embodiment, the least still geometries of the different lattice structures, such as lattice structures 10 and 20, could be positioned at one or more of the ends 214, 216 of the volute lattice structure 210 so that they provide a comfort layer.

In FIG. 2B, the volute lattice structure 220 is in the form of a spring. As shown in the example of FIG. 2B, the ends 224, 226 of the volute lattice structure 220 are narrower than a central portion 228. Each wind 222 or portion of the volute lattice structure 220 is configured to fit one on top of the other or nest within the other, thus increasing the total potential stroke or strain. Similarly to the example of FIG. 2A, one or more of the first lattice structure 10 and the second lattice structure 20 can make up the volute lattice structure 220. In alternate embodiments, lattice structures other than including the first lattice structure 10 and the second lattice structure 20 can be used to form the volute lattice structure 220. In one embodiment, the least still geometries of the different lattice structures, such as lattice structures 10 and 20, could be positioned at one or more of the ends 224, 226 of the volute lattice structure 220 so that they provide a comfort layer. In the example of FIG. 2B, one portion 230 of the volute lattice structure 220 can include spaces or gaps between respective winds 222.

Figure 3:
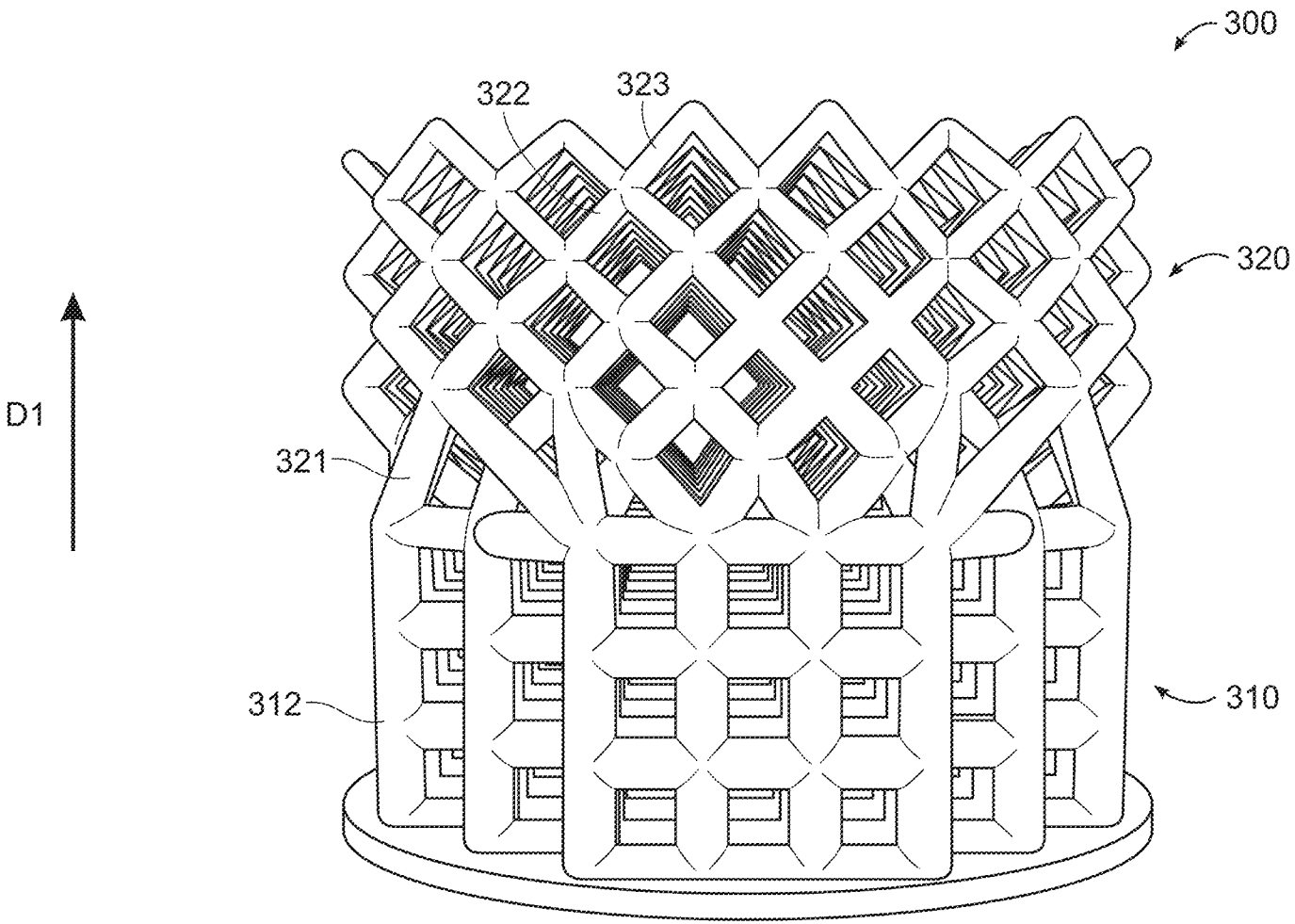
FIG. 3 illustrates a front view of another exemplary functionally graded structure incorporating aspects of the disclosed embodiments.

FIG. 3 illustrates another example of a functionally graded structure or device 300 incorporating aspects of the disclosed embodiments. In this example, the functionally graded device 300 is composed of one or more lattice structures 310, 320 where the thickness of different segments or struts 312, 321 of the respective structures 310, 320 vary throughout the device 300. For example, one portion 322 of segment 321 can be thicker than an other portion 323 of the segment 321. Similarly, segment 312 can be thicker than segment 321. In one embodiment, the segment thickness can decrease in a non-linear manner in a direction as indicated by arrow D1 in FIG. 3.

In the example of FIG. 3, a single lattice geometry of a lattice structure is repeated multiple times where thickness of each repeat or the thickness of the segments as a function changes. The change in segment thickness changes the physical characteristics of the geometry of the lattice structure so that as compression occurs, the compression response changes throughout the thickness of the device 300.

Figure 4:
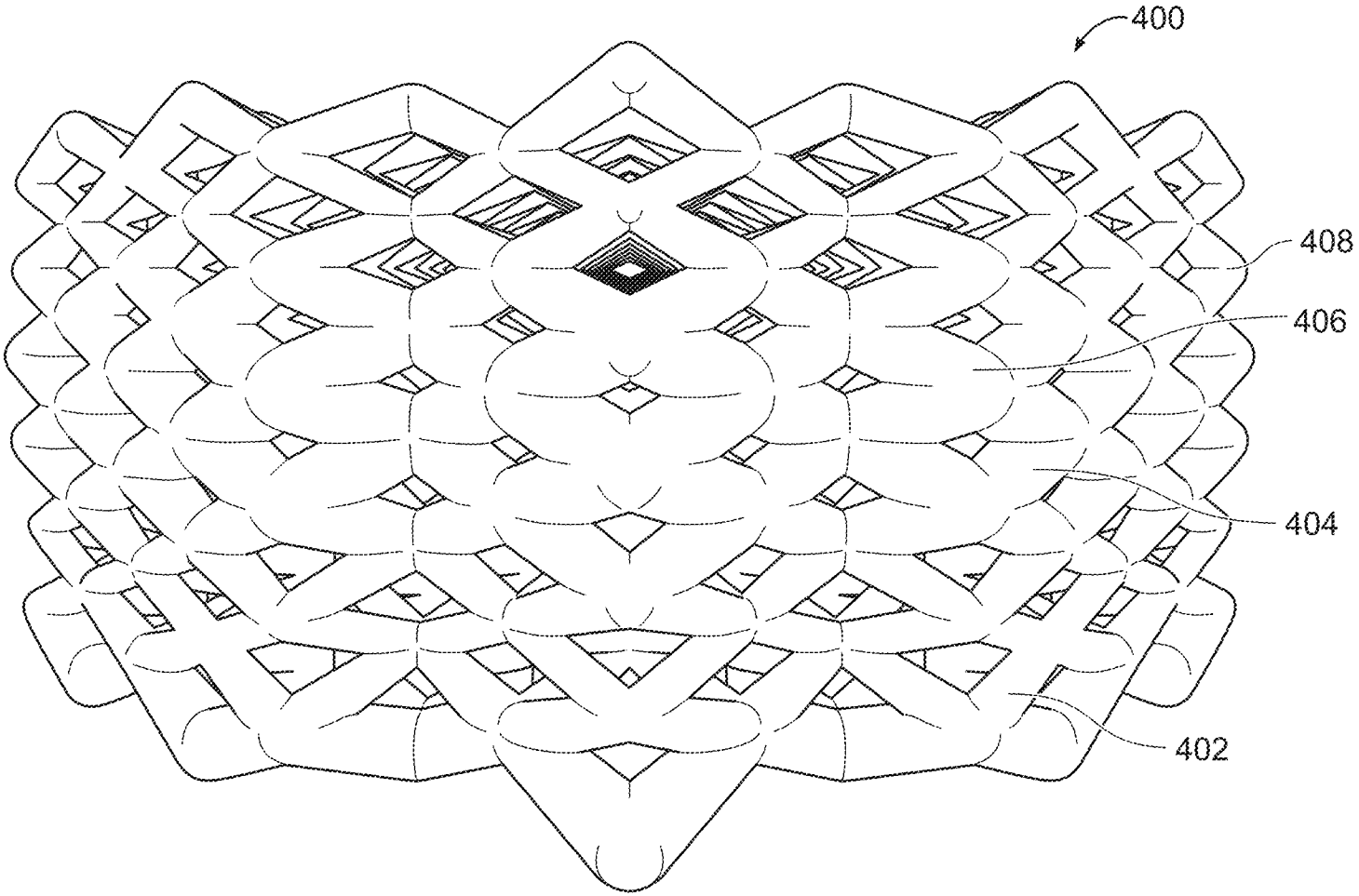
FIG. 4 illustrates a front view of another exemplary functionally graded structure incorporating aspects of the disclosed embodiments.

FIG. 4 illustrates an example of a functionally graded structure 400 incorporating aspects of the disclosed embodiments with non-uniform grading. In this example, the lattice structure or structure 400 is configured to work like four springs 402, 404, 406, 408 arranged in series, where there are two weak springs 406, 408 and two strong springs 402, 404. The weak springs 406, 408 will easily compress providing comfort until they both bottom out onto the strong springs 402, 404. Once the strong springs 402, 404 are activated, the forces required to compress the structure 400 become much higher. Since each structure 402, 404, 406, 408 in the structure 400 acts like a spring, there are many parallel springs involved, making the structure 400 and the spring system complex.

Figure 5:
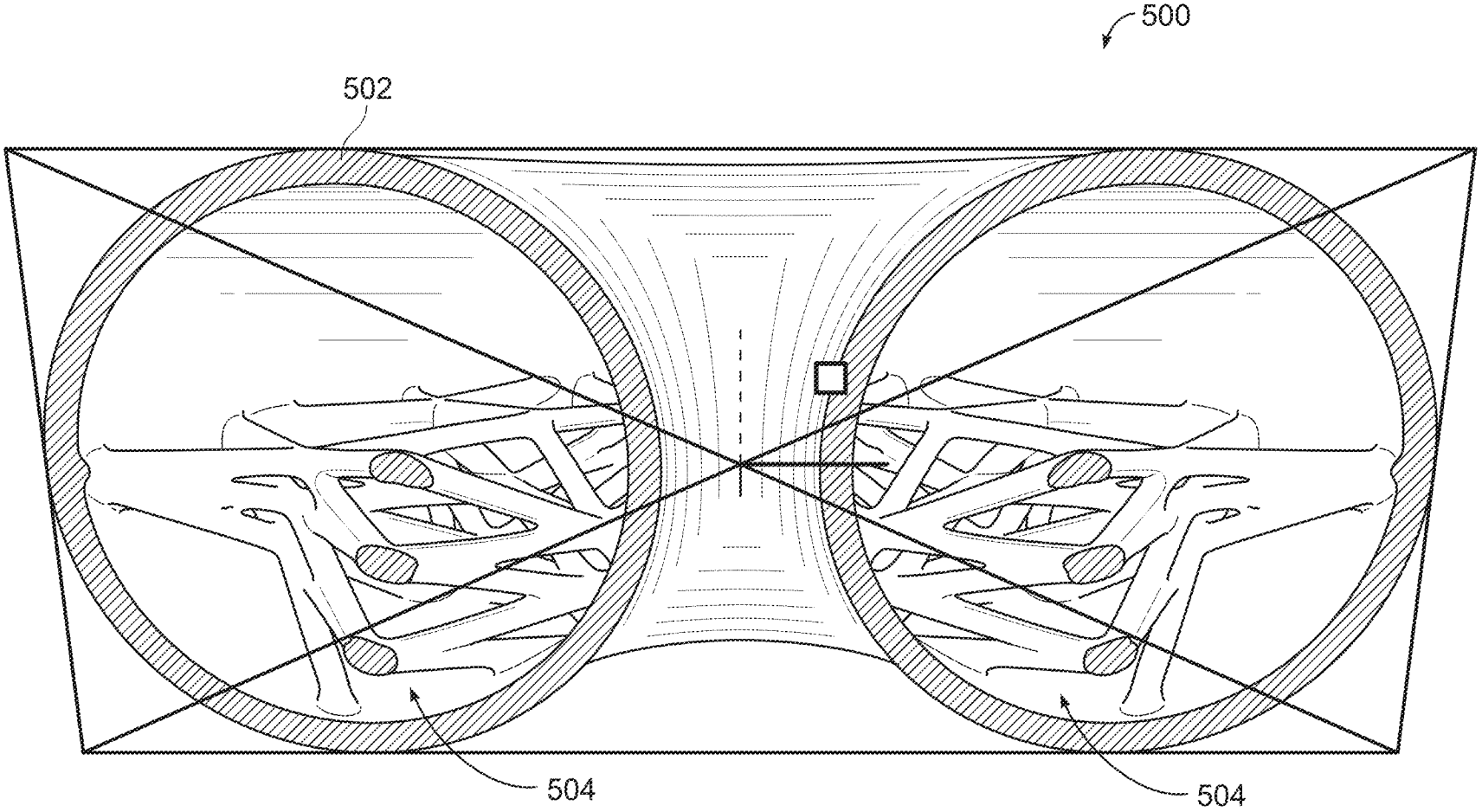
FIG. 5 illustrates another example of a functionally graded structure incorporating aspects of the disclosed embodiments.

FIG. 5 illustrates another example of a functionally graded structure incorporating aspects of the disclosed embodiments. In this example, the structure 500 is comprised of one or more geometric or lattice type structures 504 that are encapsulated in a shell 502. The shell 502 generally defines a non-permeable closed body. The one or more lattice structures 504 can include any suitable type of lattice structure. In one embodiment, the one or more lattice structures 504 can be functionally graded lattice structures in accordance with the aspects of the disclosed embodiments described herein.

In the example of FIG. 5, the shell 502 is a cylindrical shell that is shaped in the form of a donut. The outer shell 502 of the donut shape can have any desired or suitable thickness. In one embodiment, the outer shell 502 has a geometric shape that provides varying physical characteristics throughout the deformation process.

The donut shape of the shell 502 shown in FIG. 5 is partially filled with the one or more lattice structures 504. In the example of FIG. 5, the shell 502 is only one-half filled with the one or more lattice structures. This allows the donut shape of the shell 502 to deform until deformation begins at the lattice structures 504, which can increase thickness.

Figure 6:
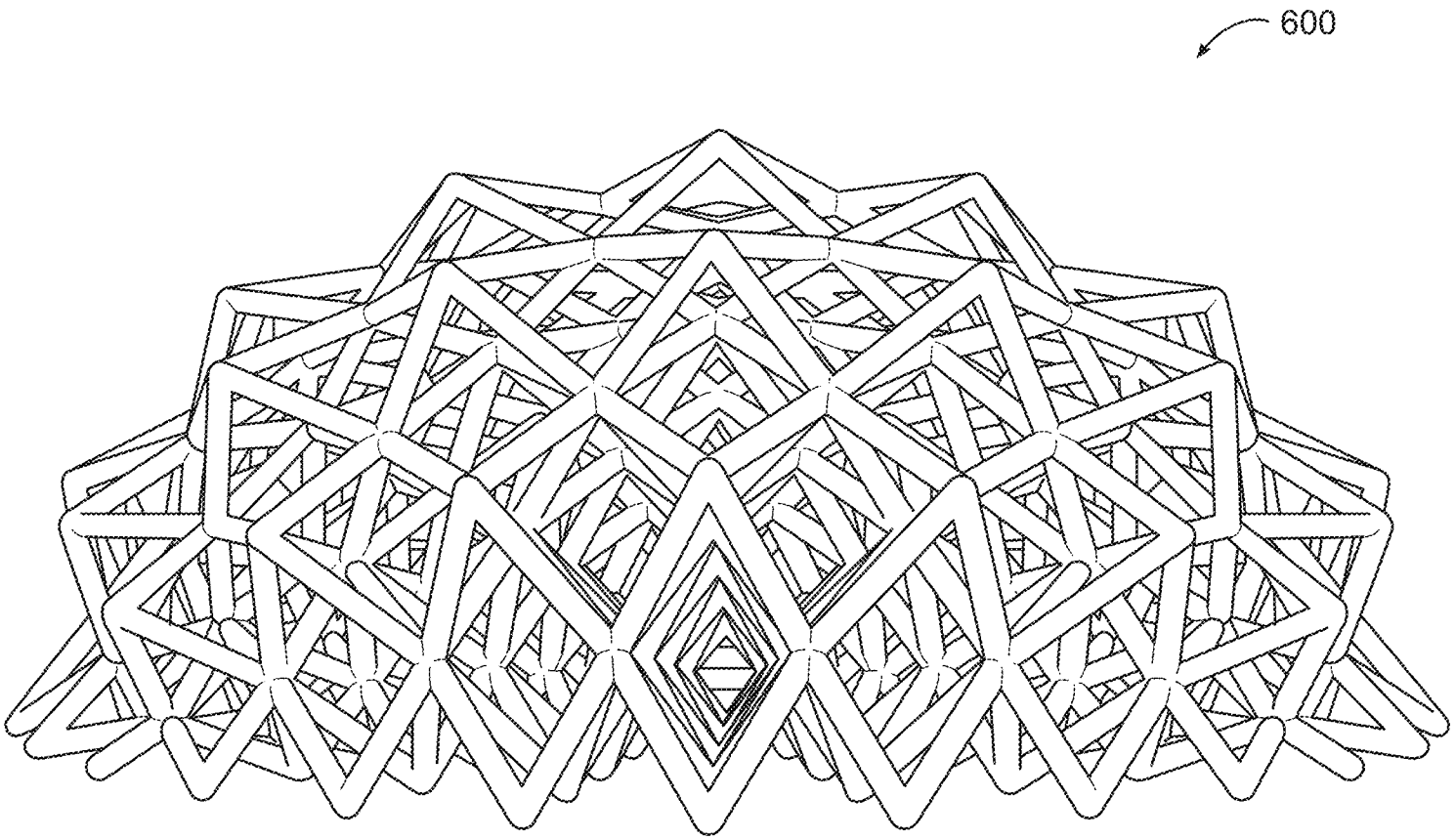
FIGS. 6-9 illustrate further examples of functionally graded structures incorporating aspects of the disclosed embodiments.
Figure 7:
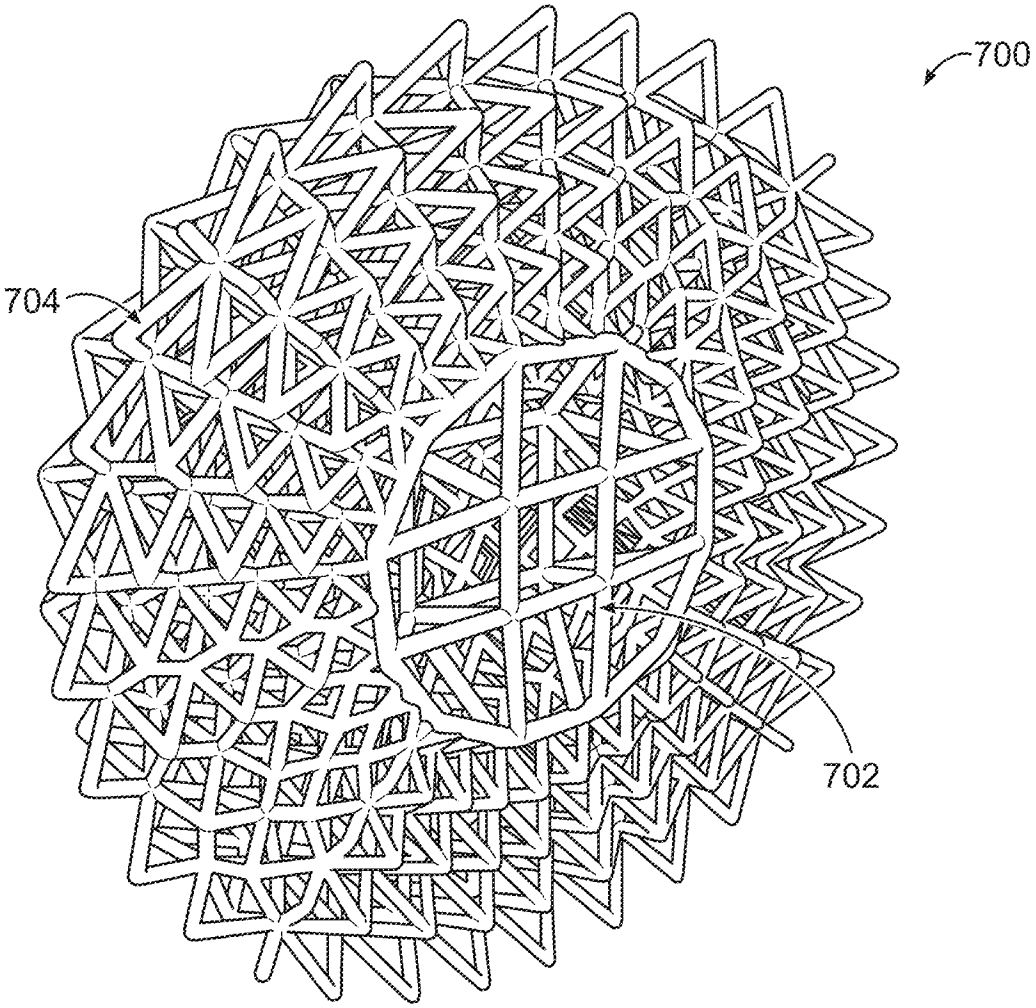

FIGS. 6 to 9 illustrate further examples of functionally graded lattice structures including aspects of the disclosed embodiments. Aspects of the disclosed embodiments can be configured to provide Off axis energy absorption and rotational energy absorption. For example, FIGS. 6 and 7 illustrate exemplary functionally grades structures incorporating aspects of the disclosed embodiments that are designed and tuned to absorb energy from off axis impact attenuating rotational forces. The lattice structures of FIGS. 6 and 7 are configured and designed to absorb energy from all directions equally or unequally such that tuning for rotational energy absorption is possible.

FIG. 7 illustrates a conformal lattice structure 700 in a hemisphere shape. In the example of FIG. 7, the center or inner region 702 comprises a lattice structure that has a different structure than the outer region 704.

Figure 8:
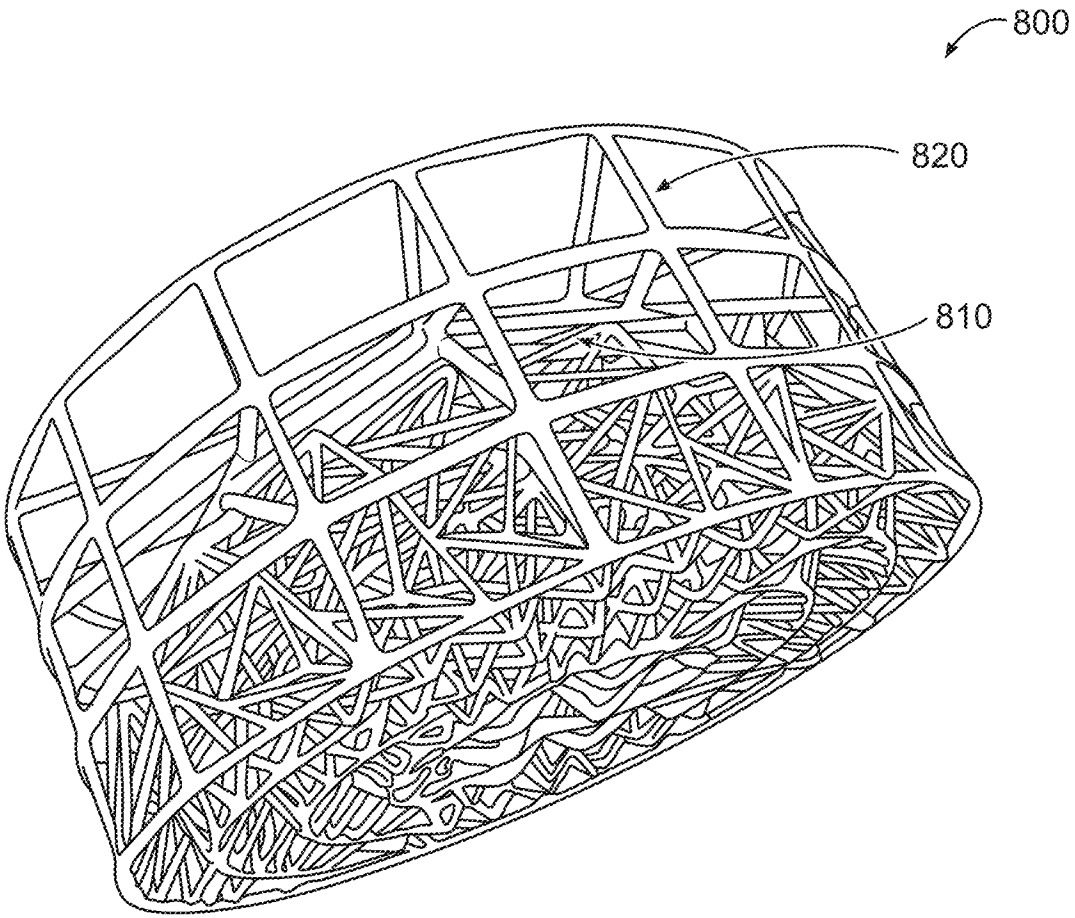
Figure 9:
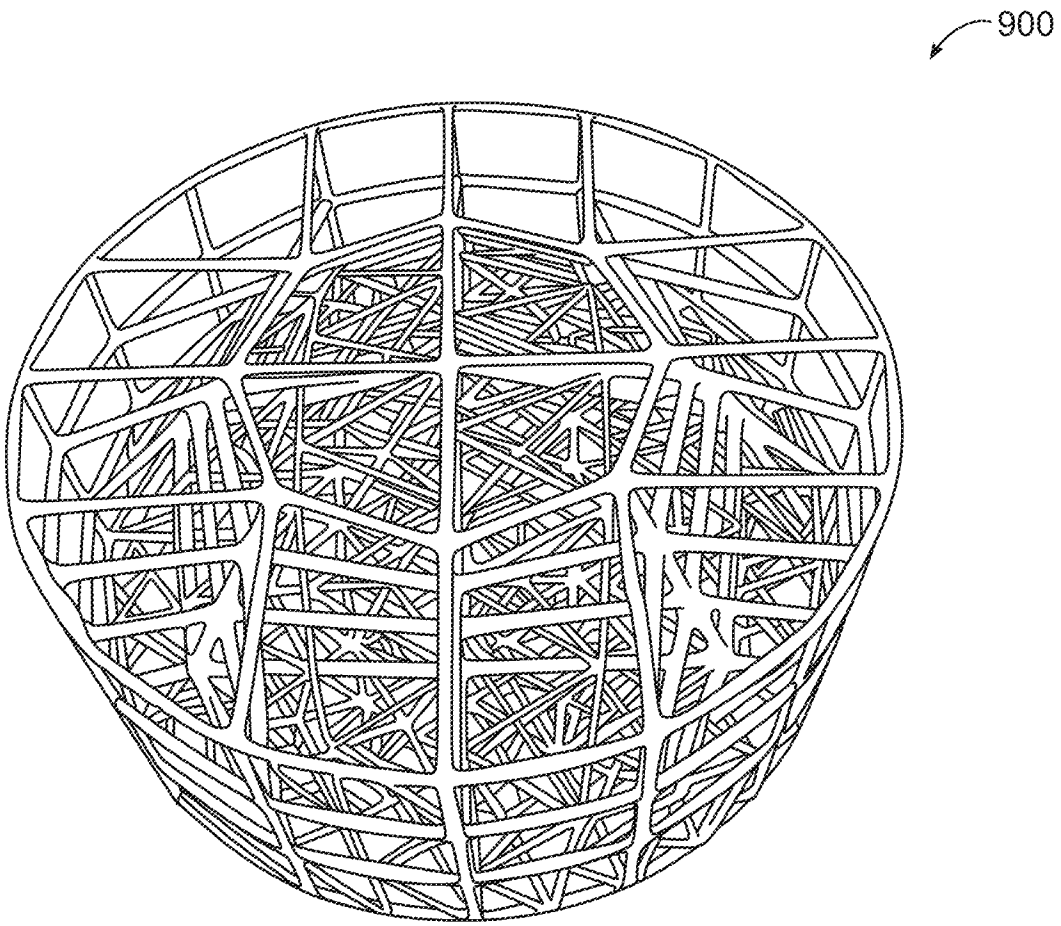

FIGS. 8-9 illustrate a conformal lattice such as the lattice structure 800 shown in FIG. 8 composed of not only the hemispherical structure 810 but also a secondary structure 820 built on top such three types of lattice each with unique space filling geometries and unique segment thicknesses. Structures such as this can have the properties tuned functionally in multiple directions through multiple parameters.

Figure 10:
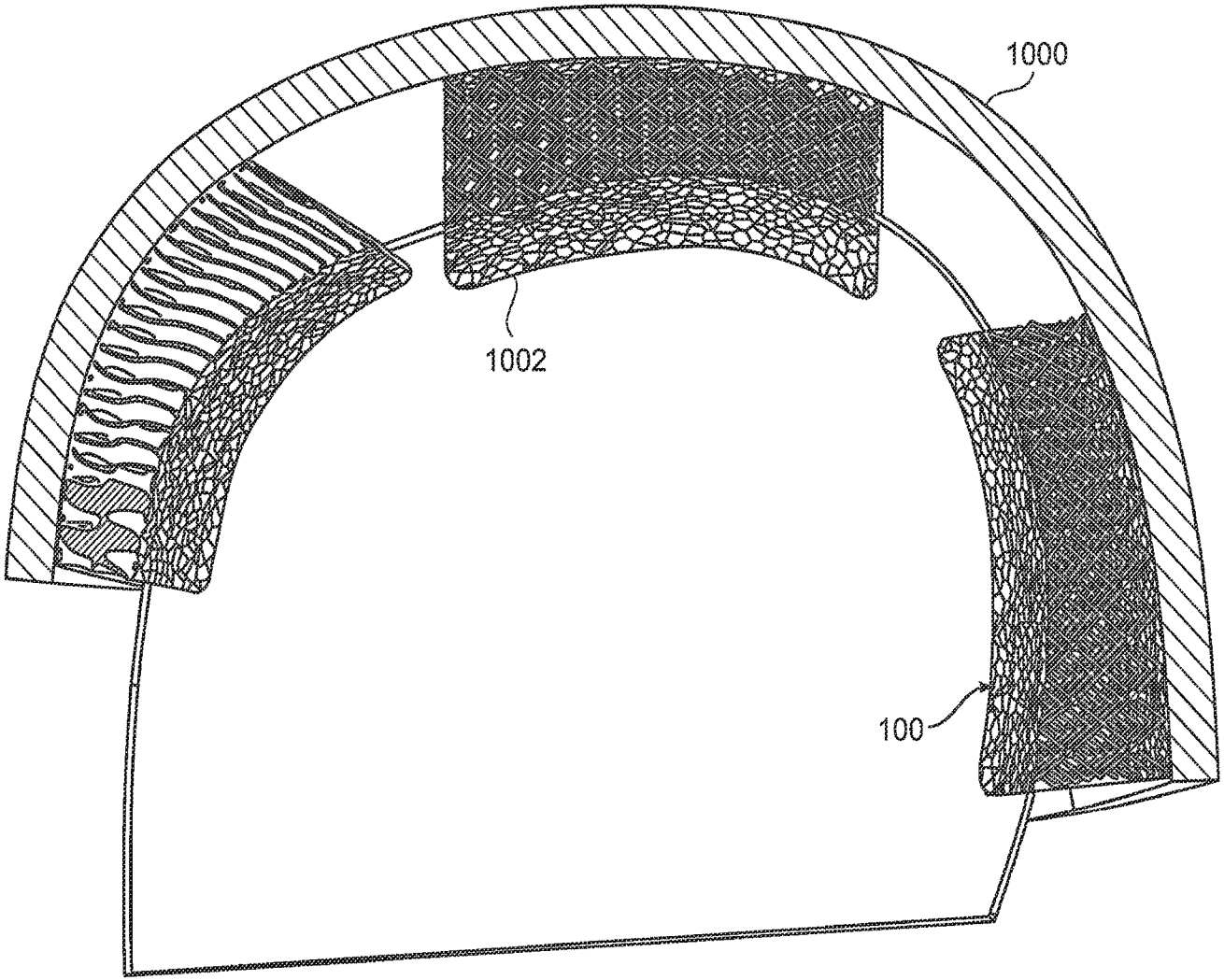
FIG. 10 is a cross-sectional view of an exemplary helmet incorporating aspects of the disclosed embodiments.

Referring to FIG. 10, the aspects of the disclosed embodiments provide a functionally graded structure for a protective application such as a helmet 1000. The example of FIG. 10 illustrates a cross-sectional view of a typical helmet 1000, such as a military type helmet. In this example, there are portions of exemplary functionally graded structures illustrated, such as the functionally graded structure 100 of FIG. 1. However, the aspects of the disclosed embodiments are not so limited. In alternate embodiments, a functionally graded structure or pad 1002 disposed in connection with the helmet 1000, or an inner shell of the helmet 1000, can comprise any one or more of the functionally graded structures described herein, or any combination thereof. Examples of the types of functionally graded structures that may be implemented in the helmet 1000, either alone or in combination, are illustrated in FIGS. 1-9.

Although only portions or segments of a functionally graded structure 1002 are shown in FIG. 10, the aspects of the disclosed embodiments are not so limited. In alternate embodiments, the functionally graded structure 1002 can be embodied in conjunction with the helmet 1000 as a continuous segment that runs along the interior of the helmet. In one embodiment, the helmet 1000 may include different types of functionally graded structures 1002 disposed at different locations in conjunction with the helmet.

The functionally graded structure of the disclosed embodiments allows for the impact absorption layer and the comfort layer to be formed into a single pad 1002, multiple pads 1002, or multiple pads of different types, optimized for a specific application or activity. The functionally graded structure of the disclosed embodiments can be made to order and custom fit into a helmet 1000. The functionally graded structure can, in at least one embodiment, be disposed between the helmet 1000 and an inner liner 1004.

Although the uses of the functionally graded structures are generally described herein with respect to helmets, the aspects of the disclosed embodiments are not so limited. Other applications can include, but are not limited to, kneepads, elbow pads, extremity pads, torso padding and impact absorption in automotive applications such as racing seats. Further applications can include phone and equipment cases, packaging and shipping materials.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A protection helmet, comprising:

an outer shell;

and a functionally graded structure disposed inside the outer shell, the functionally graded structure comprising a plurality of lattice structures with different compression response properties, a first geometry and compression response property of a first lattice structure of the plurality of lattice structures being different from a second geometry and compression response property of a second lattice structure of the plurality of lattice structures, the first lattice structure has a first thickness and the second lattice structure has a second thickness that is different from the first thickness, wherein the first lattice structure directly interconnects with the second lattice structure through a plurality of individual nodes and wherein the first lattice structure includes a plurality of first segments connected to the plurality of nodes and wherein the first segments define a first set of pores having a first quadrilateral shape and wherein the second lattice structure includes a plurality of second segments connected to the plurality of nodes and wherein the second segments define a second set of pores having a second quadrilateral shape and wherein the first segments extend from the nodes at an acute angle to that of the second segments whereby the first quadrilateral shape is oriented at the acute angle to the second quadrilateral shape, wherein the plurality of lattice structures are arranged in a stack inside the outer shell and an order of lattice structures in the stack is from a least stiff lattice structure to a most stiff lattice structure, wherein at least one segment of the functionally graded structure comprises a donut shaped body structure that defines a cavity, the cavity having a circular cross section, wherein at least one lattice structure of the plurality of lattice structures is arranged in at least a portion of the cavity, wherein the at least one lattice structure comprises two different geometries.

2. The helmet according to claim 1, wherein the plurality of lattice structures include one or more lattice structures that differ in geometry from the geometries of the first and second lattice structures.

* * * * *